US010640315B2

(12) United States Patent
Miyajima et al.

(10) Patent No.: US 10,640,315 B2
(45) Date of Patent: May 5, 2020

(54) DRIVE APPARATUS AND IMAGE FORMING APPARATUS

(71) Applicant: KONICA MINOLTA, INC., Tokyo (JP)

(72) Inventors: Satoshi Miyajima, Hino (JP); Hiroshi Oyama, Hino (JP); Remi Ishikawa, Mitaka (JP); Tadayuki Ueda, Kokubunji (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 16/171,398

(22) Filed: Oct. 26, 2018

(65) Prior Publication Data

US 2019/0127168 A1 May 2, 2019

(30) Foreign Application Priority Data

Oct. 30, 2017 (JP) ..... 2017-208813

(51) Int. Cl.
*B65H 7/20* (2006.01)
*B65H 5/06* (2006.01)
*G03G 15/00* (2006.01)

(52) U.S. Cl.
CPC ..... *B65H 7/20* (2013.01); *B65H 5/062* (2013.01); *G03G 15/6529* (2013.01);
(Continued)

(58) Field of Classification Search
CPC . B65H 5/06; B65H 5/062; B65H 7/00; B65H 7/02; B65H 7/20; B65H 2403/923; B65H 2513/10; B65H 2513/104; B65H 2515/32; B65H 2515/322; B65H 2515/81; B65H 2555/25; B65H 2555/26
See application file for complete search history.

(56) References Cited

U.S. PATENT DOCUMENTS

2001/0054787 A1* 12/2001 Yamagishi ..... B65H 5/062 271/3.17
2016/0251182 A1* 9/2016 Kii ..... B65H 7/00 358/1.12

(Continued)

FOREIGN PATENT DOCUMENTS

JP 2006-017988 A 1/2006
JP 2012091511 A * 5/2012 ..... B41J 11/0095

*Primary Examiner* — Prasad V Gokhale
(74) *Attorney, Agent, or Firm* — Buchanan Ingersoll & Rooney PC

(57) ABSTRACT

A drive apparatus according to the present invention includes a stepping motor that transmits power to a rotating shaft of a conveyance roller, a brushless motor that transmits power to the rotating shaft of the conveyance roller, a first controller that controls an operation of the stepping motor so that the stepping motor rotates at a constant speed, and a second controller that controls an operation of the brushless motor. The second controller switches control of the brushless motor between, in accordance with a conveyance state of the sheet, assist control in which power of the brushless motor assists a rotation of the stepping motor, brake control in which power of the brushless motor prevents the rotation of the stepping motor, and neutral control in which power of the brushless motor does not affect the rotation of the stepping motor.

7 Claims, 6 Drawing Sheets

(52) U.S. Cl.
CPC .. *B65H 2403/923* (2013.01); *B65H 2513/104* (2013.01); *B65H 2515/32* (2013.01); *B65H 2515/322* (2013.01); *B65H 2515/81* (2013.01)

(56) References Cited

U.S. PATENT DOCUMENTS

2018/0334341 A1* 11/2018 Miyajima ..... G03G 15/50
2018/0334342 A1* 11/2018 Miyajima ..... B65H 7/00

* cited by examiner

300

| Reference current value difference [mA] | Setting duty [%] |
|---|---|
| -300 | -30 |
| -200 | -20 |
| -100 | -10 |
| -50 | -5 |
| ±0 | 0 |
| +50 | +5 |
| +100 | +10 |
| +200 | +20 |
| +300 | +30 |

DRIVE APPARATUS AND IMAGE FORMING APPARATUS

CROSS-REFERENCE TO RELATED APPLICATION

Japanese patent application No. 2017-208813 filed on Oct. 30, 2017, including description, claims, drawings, and abstract the entire disclosure is incorporated herein by reference in its entirety.

BACKGROUND

1. Technological Field

The present invention relates to a drive apparatus and an image forming apparatus.

2. Description of the Related Art

In an image forming apparatus such as an electrophotographic printer, a conveyance roller for conveying a sheet is driven by a stepping motor. The stepping motor makes it possible to perform accurate speed and position control with a simple control configuration.

Meanwhile, in recent image forming apparatuses, speeding up of printing has progressed, and along with this, shortening of the acceleration time of the conveyance roller and the like is required. However, with a general-purpose stepping motor used in an image forming apparatus, since out-of-step occurs due to insufficient output torque, it is not possible to accelerate the conveyance roller in a short time.

In relation to this, Unexamined Japanese Patent Publication No. 2006-0179881 discloses a technique in which the power of the direct current (DC) brushless motor is additionally transmitted to a drive shaft driven by the stepping motor, and the drive shaft is rotated by the power of two motors. According to this technique, the load torque of the stepping motor at startup is reduced, and the conveyance roller can be accelerated in a short time.

SUMMARY

When the sheet is conveyed along a conveying path inside the image forming apparatus, in some cases, one sheet is held by two pairs of conveyance rollers adjacent to each other along the conveying direction simultaneously. Normally, the two pairs of conveyance rollers are driven at the same rotation speed so as to convey the sheet at the same conveyance speed.

However, even if the two pairs of conveyance rollers are driven at the same rotation speed, in some cases, a difference in the sheet conveyance speed of the two pairs of conveyance rollers occurs due to the change with time of the conveyance roller and the mechanical tolerance. In the case where there is a difference in sheet conveyance speed between the two pairs of conveyance rollers, when the two pairs of conveyance rollers hold one sheet simultaneously, the force is transmitted through the sheet, and the driving load of the conveyance roller may change. For example, when the sheet conveyance speed of the conveyance roller disposed downstream of the conveying path is higher than the sheet conveyance speed of the conveyance roller disposed on the upstream, the upstream conveyance roller is pulled by the downstream conveyance roller via the sheet, and the driving load of the upstream conveyance roller decreases. Conversely, in a case where the sheet conveyance speed of the conveyance roller disposed downstream of the conveying path is slower than the sheet conveyance speed of the conveyance roller disposed upstream, when the sheet to be conveyed is thick, the upstream conveyance roller pushes the downstream conveyance roller via the sheet, whereby the driving load of the upstream conveyance roller increases.

In a case where the stepping motor is rotated at high speed, when the driving load of the conveyance roller changes, the stepping motor may step out. In this point, in the mechanism in which the power of the DC brushless motor is additionally transmitted to the power of the stepping motor to drive the conveyance roller, even if the driving load of the conveyance roller increases, the stepping motor is difficult to step out. On the other hand, in such the mechanism, since the torque margin in the rotation direction of the stepping motor is set small considering the auxiliary torque from the DC brushless motor, when the driving load of the conveyance roller decreases, the stepping motor may step out.

The present invention has been made in view of the above-described problems. Accordingly, it is an object of the present invention to provide the drive apparatus and the image forming apparatus capable of preventing the stepping motor from stepping out when the rotating shaft of the conveyance roller is driven by power of the stepping motor and the brushless motor.

To achieve at least one of the abovementioned objects, according to an aspect of the present invention, the drive apparatus reflecting one aspect of the present invention comprises: a stepping motor that transmits power to a rotating shaft of a conveyance roller for conveying a sheet; a brushless motor that transmits power to said rotating shaft of said conveyance roller, a first controller that controls an operation of said stepping motor so that said stepping motor rotates at a constant speed; and a second controller that controls an operation of said brushless motor, wherein said second controller switches control of said brushless motor between, in accordance with a conveyance state of the sheet conveyed by said conveyance roller, assist control in which power of said brushless motor assists a rotation of said stepping motor, brake control in which power of said brushless motor prevents the rotation of said stepping motor, and neutral control in which power of said brushless motor does not affect the rotation of said stepping motor.

The objects, features, and characteristics of this invention other than those set forth above will become apparent from the description given herein below with reference to preferred embodiments illustrated in the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
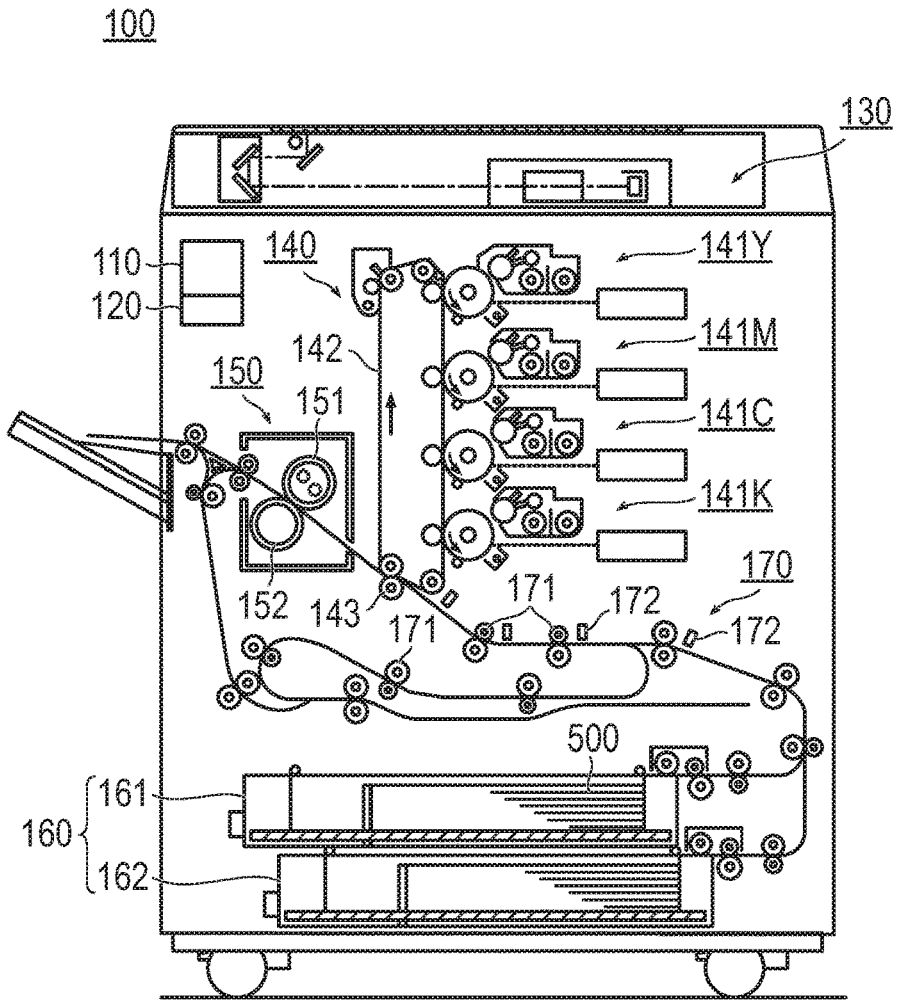
FIG. 1 is a cross-sectional view showing a schematic configuration of the image forming apparatus according to an embodiment of the present invention.

Hereinafter, one or more embodiments of the present invention will be described with reference to the drawings. However, the scope of the invention is not limited to the disclosed embodiments.

Hereinafter, embodiments of the present invention will be described in detail with reference to the drawings. In the description of the drawings, the same elements are denoted by the same reference numerals, and duplicate descriptions are omitted. Also, the dimensional ratios of the drawings are exaggerated for convenience of explanation and may differ from the actual ratio.

FIG. 1 is a cross-sectional view showing a schematic configuration of an image forming apparatus 100 according to an embodiment of the present invention. As shown in FIG. 1, the image forming apparatus 100 of the present embodiment includes a controller 110, a storage 120, an image reader 130, an image former 140, a fixer 150, a sheet feeder 160, and a sheet conveyor 170.

The controller 110 is a central processing unit (CPU), and performs control of each of the above units and various arithmetic processing according to a program.

The storage 120 includes a read only memory (ROM) in which various programs and various data are stored in advance, a random access memory (RAM) for temporarily storing programs and data as a work area, a hard disk for storing various programs and various data, and the like. A setting table for setting the output torque of a DC brushless motor for driving a conveyance roller 171 is stored in the storage 120.

The image reader 130 includes a light source such as a fluorescent lamp and an image pickup element such as a charge coupled device (CCD) image sensor. The image reader 130 applies light from a light source to a document set at a predetermined reading position, photoelectrically converts the reflected light by the image pickup element, and generates image data from the electrical signal.

The image former 140 includes image forming units 141Y to 141K corresponding to toners of respective colors of Y (yellow), M (magenta), C (cyan), and K (black). A toner image formed by the processes of charging, exposing, and developing by the image forming units 141Y to 141K are successively superimposed on an intermediate transfer belt 142 and transferred onto a sheet 500 by a secondary transfer roller 143.

The fixer 150 includes a heating roller 151 and a pressure roller 152. The fixing unit 150 heats and pressurizes the sheet 500 conveyed to a fixing nip between the both rollers 151 and 152 to fuse-fix the toner image on the sheet 500 to a surface thereof.

The sheet feeder 160 includes a plurality of sheet feeding trays 161 and 162, and feeds the sheets 500 accommodated in the sheet feeding trays 161 and 162 one by one to a downstream conveying path.

The sheet conveyor 170 includes a plurality of conveyance rollers 171 for conveying the sheet 500, and conveys the sheet 500 between the image former 140, the fixing unit 150, and the sheet feeder 160. In the image forming apparatus 100 of the present embodiment, one or more of the plurality of conveyance rollers 171 are driven by a drive apparatus 200 (see FIG. 2) having two motors. A photosensor 172 for detecting the presence or absence of the sheet 500 is provided upstream of each conveyance roller 171 in the sheet conveying direction.

Next, with reference to FIG. 2 and FIG. 3, the driver 200 for driving the conveyance rollers 171 by the two motors will be described in detail.

Figure 2:
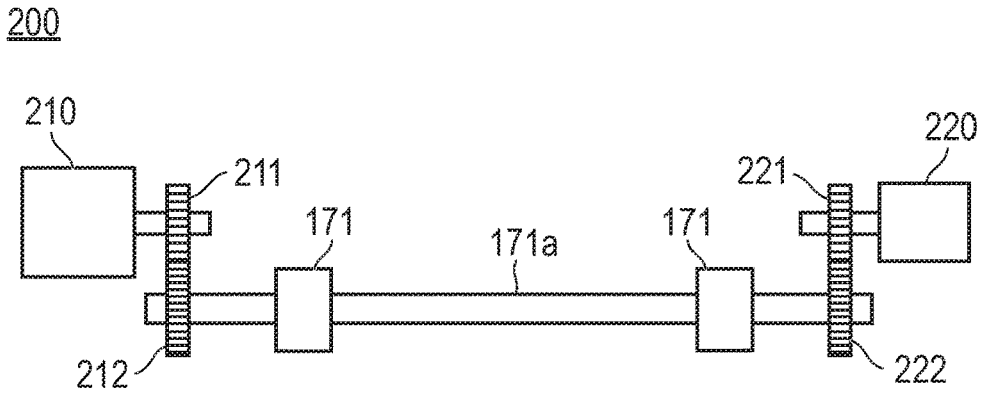
FIG. 2 is a plane view showing a schematic configuration of a driver.
Figure 3:
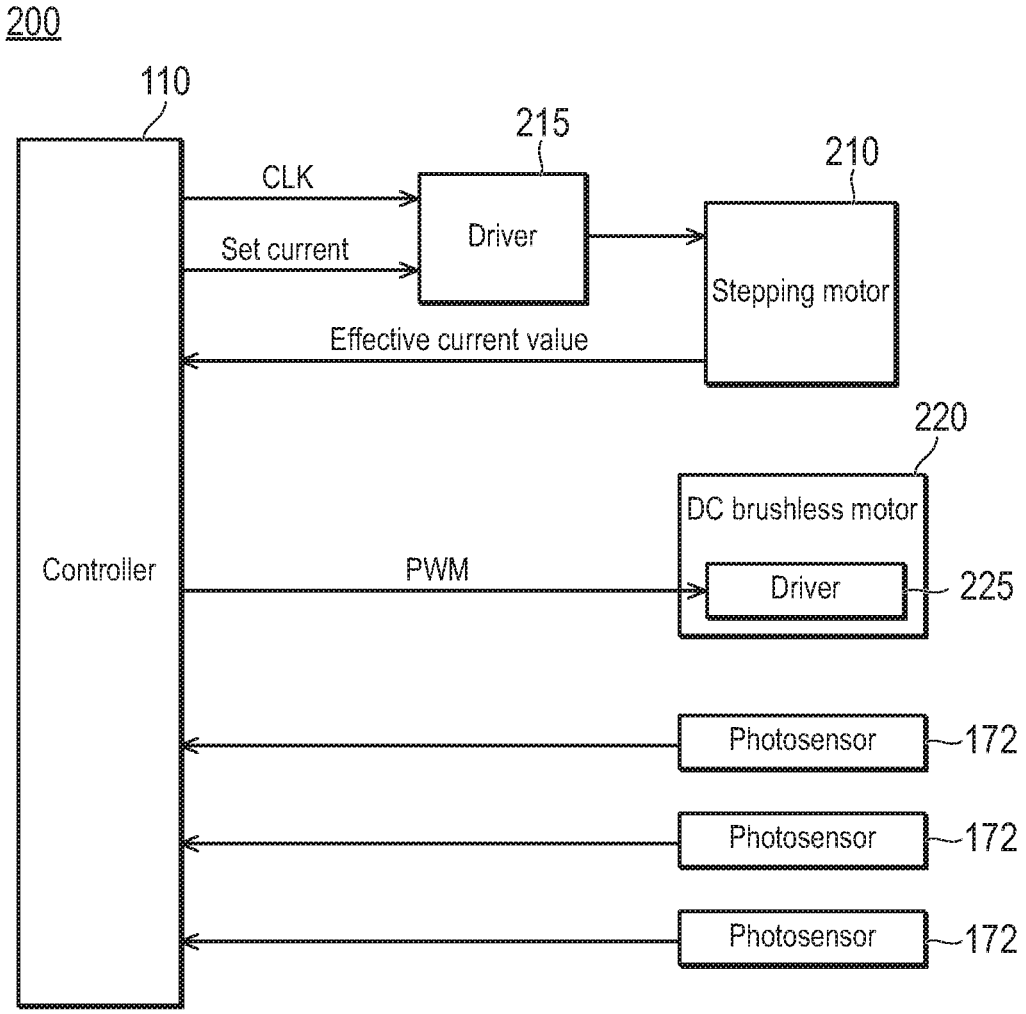
FIG. 3 is a block diagram showing a control system of the driver.

FIG. 2 is a plane view showing a schematic configuration of the driver 200, and FIG. 3 is a block diagram showing a control system of the driver 200.

As shown in FIG. 2, the driver 200 includes a stepping motor 210 and a DC brushless motor 220. The stepping motor 210 is coupled via a plurality of gears 211 and 212 to a rotating shaft 171*a* of the conveyance roller 171 so as to transmit power. Further, the DC brushless motor 220 is coupled via a plurality of gears 221 and 222 to the rotating shaft 171*a* of the conveyance roller 171 so as to transmit power. The output torque of the stepping motor 210 is larger than the output torque of the DC brushless motor 220, and the rotation speed of the conveyance roller 171 is controlled by the rotation speed of the stepping motor 210.

As shown in FIG. 3, the controller 110 of the image forming apparatus 100 controls the operations of the stepping motor 210 and the DC brushless motor 220 as first and second controllers.

The controller 110 as the first controller, by transmitting a clock signal (CLK) to a driver 215 for the stepping motor 210, and setting the operating frequency of the stepping motor 210, controls the rotation speed of the stepping motor 210. In addition, the controller 110 transmits a set current signal to the driver 215 to set the current value of the stepping motor 210, thereby controlling the torque generated m the stepping motor 210. Further, the controller 110 is electrically connected to the stepping motor 210, and detects a current value (hereinafter also referred to as "effective current value") of a current actually supplied from the driver 215 to the stepping motor 210. In the case where the stepping motor 210 rotates at a high speed, even if the stepping motor 210 is subjected to constant current control, the stepping motor 210 shows the behavior by constant voltage control, and the effective current value changes according to the load acting on the stepping motor 210.

The controller 110 as the second controller transmits a PWM (Pulse Width Modulation) signal to a built-in driver 225 of the DC brushless motor 220 to set a control value (duty command value) of the DC brushless motor 220, thereby controlling the torque generated in the DC brushless motor 220.

Further, the controller 110 is electrically connected to the plurality of photosensors 172 disposed on the conveying path of the sheet 500, and acquires output signals of the photosensors 172.

Note that the image forming apparatus 100 may include constituent elements other than the above-described constituent elements, or may not include a part of the above-described constituent elements.

In the image forming apparatus 100 configured as described above, when the conveyance rollers 171 driven by the two motors 210 and 220 conveys the sheet 500, the control of the DC brushless motor 220 is switched according to the conveyance state of the sheet 500. Hereinafter, with reference to FIGS. 4 to 8, the operation of the image forming apparatus 100 according to the present embodiment will be described in detail.

Figure 4:
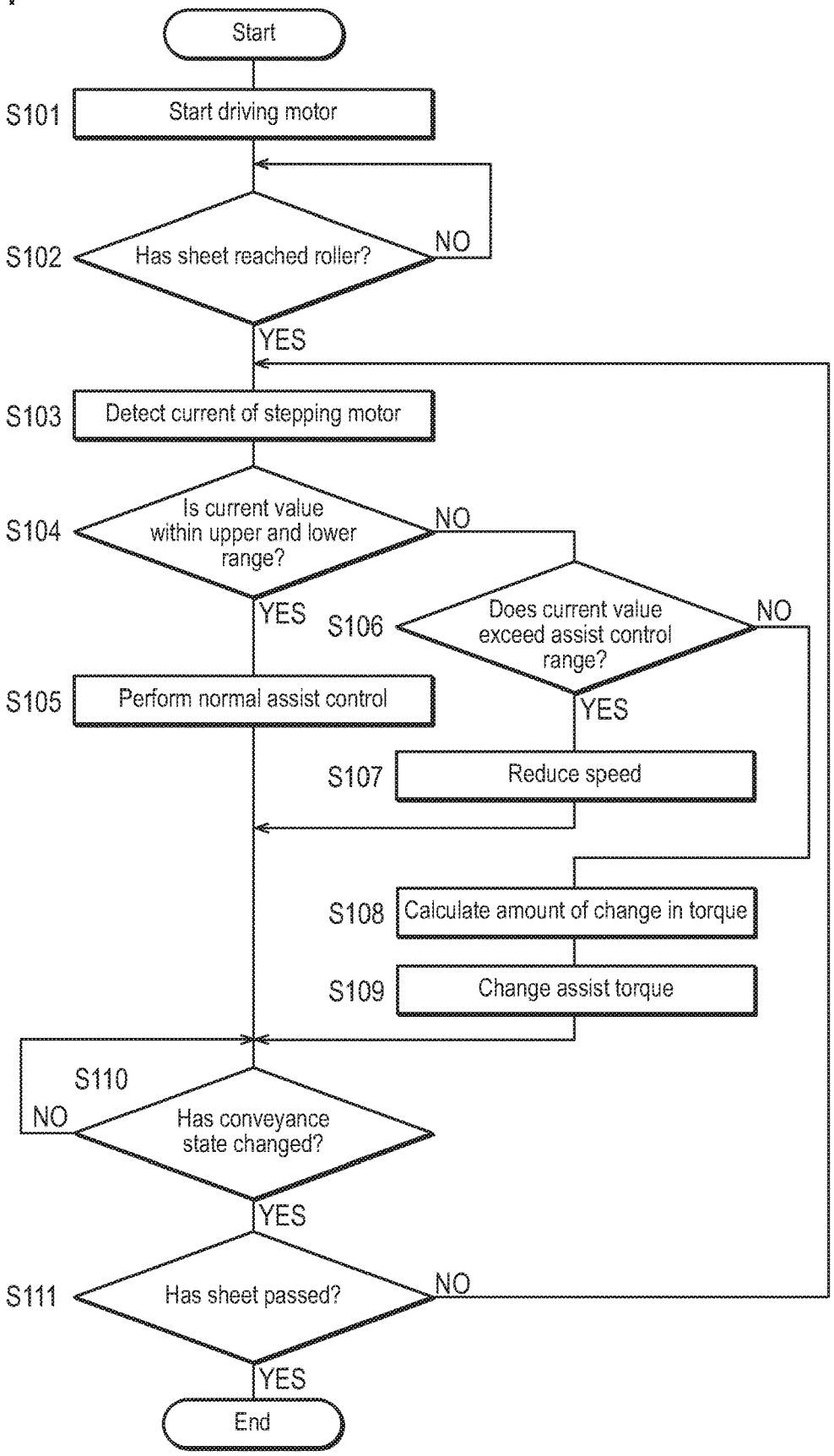
FIG. 4 is a flowchart showing a procedure of the sheet conveyance process.

FIG. 4 is a flowchart showing a procedure of a sheet conveyance process performed by the image forming apparatus 100. The algorithm shown by the flowchart of FIG. 4 is stored as the program in the storage 120, and is executed by the controller 110.

First, the controller 110 starts driving the stepping motor 210 and the DC brushless motor 220 (step S101). More specifically, the controller 110 sets the rotation speed of the stepping motor 210 to drive the stepping motor 210 at a predetermined rotation speed so that the conveyance roller 171 to be controlled is rotated at a constant speed. In addition, the controller 110 sets the duty command value of the DC brushless motor 220 to an initial value (for example, 50%), sets the assist torque of the DC brushless motor 220, and drives the DC brushless motor 220. The stepping motor 210 is subjected to constant current control with a predetermined set current value.

Next, the controller 110 determines whether the sheet 500 has reached the conveyance roller 171 to be controlled (step S102). In the present embodiment, when the photosensor 172 provided in the vicinity of the upstream of the conveyance roller 171 to be controlled detects the leading end of the sheet 500, the controller 110 determines that the sheet 500 has reached the conveyance roller 171 to be controlled. When the sheet 500 has reached the conveyance roller 171 to be controlled, the sheet 500 is simultaneously held by the conveyance roller 171 to be controlled and another conveyance roller 171 disposed adjacent to the conveyance roller 171 to be controlled on the upstream side. At this time, if there is a speed difference between the sheet conveyance speeds of the two pairs of conveyance rollers 171, the load acting on the conveyance roller 171 to be controlled changes.

Next, the controller 110 detects the effective current value of the stepping motor 210 (step S103). More specifically, in order to detect the load acting on the stepping motor 210, the controller 110 detects the current value actually supplied to the stepping motor 210.

Figures 5, 6:
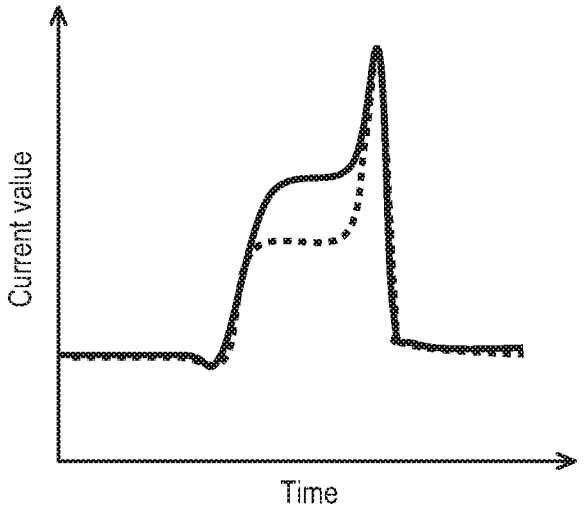
FIG. 5 is a diagram showing a current waveform for one phase of the stepping motor.
FIG. 6 is a diagram showing an example of a duty setting table.

FIG. 5 is a diagram showing a current waveform for one phase of the stepping motor. The solid line in FIG. 5 shows the current waveform in the case where the load acting on the stepping motor 210 is large, and the broken line in FIG. 5 shows the current waveform in the case where the load acting on the stepping motor 210 is small. As shown in FIG. 5, in the high rotation region, the effective current value of the stepping motor 210 increases as the load increases, and decreases as the load decreases. In the image forming apparatus 100 of the present embodiment, by detecting the effective current value of the stepping motor 210, the load acting on the stepping motor 210 is detected. The effective current value of the stepping motor 210 is calculated, for example, as an RMS (Root Mean Square) value or average value of the current waveform for one phase supplied to the stepping motor 210.

Next, the controller 110 determines whether the effective current value of the stepping motor 210 is within a predetermined upper and lower limit range (step S104). More specifically, the controller 110 determines whether the current effective current value of the stepping motor 210 is included between the predetermined upper limit value and the predetermined lower limit value. The predetermined upper limit value and the predetermined lower limit value are current values serving as references when switching the control of the DC brushless motor 220, and are set to a value of ±30 mA with respect to the reference current value, for example. The reference current value is set to a different value according to the type of the sheet to be conveyed, the sheet conveyance speed, the structure of the conveyance roller, and the like. The reference current value is determined in advance, for example, by experiments or the like.

When determining that the effective current value of the stepping motor 210 is within the predetermined upper and lower range (step S104: YES), the controller 110 performs normal assist control (step S105). More specifically, the controller 110 controls the DC brushless motor 220 so that the DC brushless motor 220 assists the rotation of the stepping motor 210 by the assist torque set at the start of driving of the DC brushless motor 220.

On the other hand, when determining that the effective current value of the stepping motor 210 is not within the predetermined upper and lower range (step S104: NO), the controller 110 determines whether the effective current value of the stepping motor 210 exceeds the assist control range (Step S106). In other words, the controller 110 determines whether the load acting on the stepping motor 210 exceeds the upper limit value of the range in which the stepping motor 210 can be assisted by the torque of the DC brushless motor 220.

When determining that the effective current value exceeds the assist control range (step S106: YES), the controller 110 lowers the rotation speed of the stepping motor 210 (step S107) and the process proceeds to step S110. As a result, the conveyance roller 171 rotates at a low speed to convey the sheet 500.

On the other hand, when determining that the effective current value does not exceed the assist control range (step S106: NO), the controller 110 calculates the amount of change in torque of the DC brushless motor 220 (step S108). More specifically, the controller 110 refers to a duty setting table 300 (see FIG. 6) stored in the storage 120 to calculate, from the effective current value of the stepping motor 210, the amount of change in the duty command value of the DC brushless motor 220.

FIG. 6 is a diagram showing an example of a duty setting table. In the duty setting table 300, the amount of change in the duty command value is defined so that the output torque of the DC brushless motor decreases as the effective current value of the stepping motor 210 decreases. After calculating the difference between the effective current value of the stepping motor 210 and the reference current value, the controller 110 refers to the duty setting table 300 and calculates the amount of change in the duty command value corresponding to the difference of the current values.

Then, the controller 110 changes the assist torque of the DC brushless motor 220 (step S109), and the process proceeds to step S110. More specifically, first, the controller 110 adds or subtracts the change amount calculated in the process shown in step S108 with respect to the duty command value set at the time of startup so as to calculate a new duty command value. Then, the controller 110 sets the duty command value of the DC brushless motor 220 to the new command value, and changes the output torque of the DC brushless motor 220. As a result, when the load acting on the stepping motor 210 is smaller than the reference value, the output torque of the DC brushless motor 220 is decreased. When the load acting on the stepping motor 210 is larger than the reference value, the output torque of the DC brushless motor 220 is increased.

Next, the controller 110 determines whether the conveyance state of the sheet 500 has changed (step S110). In the present embodiment, for example, when the trailing end of the sheet 500 has passed through the other conveyance roller adjacent to the conveyance roller to be controlled on the upstream while the sheet 500 is passing through the conveyance roller to be controlled, the controller 110 determines that the conveyance state of the sheet 500 has changed. Further, when the leading end of the sheet 500 has reached the other conveyance roller disposed adjacent to the conveyance roller to be controlled on the downstream side while the sheet 500 is passing through the conveyance roller to be controlled, the controller 110 determines that the conveyance state of the sheet 500 has changed. Further, when the trailing end of the sheet 500 has passed through the conveyance roller 171 to be controlled, the controller 110 determines that the conveyance state of the sheet 500 has changed. The change in the conveyance state of the sheet 500 is recognized by the output signal of the photosensor 172 provided in the vicinity of each conveyance roller 171.

When determining that the conveyance state of the sheet 500 has not changed (step S110: NO), the controller 110 waits until the conveyance state of the sheet 500 changes. On the other hand, when determining that the conveyance state of the sheet 500 has changed (step S110: YES), the controller 110 determines whether the sheet 500 has passed through the conveyance roller 171 to be controlled (step S11). More specifically, from the output signal of the photosensor 172 provided in the vicinity of the upstream of the conveyance roller 171 to be controlled, the controller 110 determines whether the trailing end of the sheet 500 has passed through the conveyance roller 171 to be controlled.

When determining that the sheet 500 has passed through the conveyance roller 171 to be controlled (step S111: YES), the controller 110 ends the process. On the other hand, when determining that the sheet 500 has not passed through the conveyance roller 171 to be controlled (step S111: NO), the controller 110 returns to the process of step S103. Then, the controller 110 repeats the processing of step S103 and the subsequent steps until the sheet 500 has passed through the conveyance roller 171 to be controlled.

As described above, according to the process of the flowchart shown in FIG. 4, the control of the DC brushless motor 220 is switched according to the conveyance state of the sheet 500. More specifically, when the load acting on the stepping motor 210 decreases according to the conveyance state of the sheet 500, the output torque of the DC brushless motor 220 is reduced. On the other hand, when the load acting on the stepping motor 210 increases according to the conveyance state of the sheet 500, the output torque of the DC brushless motor 220 is increased. According to such a configuration, the load acting on the stepping motor 210 is adjusted, and step-out of the stepping motor 210 is prevented.

In the process of the flowchart shown in FIG. 4, when the effective current value of the stepping motor 210 exceeds the assist control range, the rotation speed of the stepping motor 210 is lowered. However, when the effective current value of the stepping motor 210 exceeds the assist control range, the rotation of the stepping motor 210 may be stopped and the process may be ended.

Next, with reference to FIGS. 7A to 7F, the sheet conveyance process of this embodiment will be described more specifically. In the following description, for the sake of convenience of explanation, it is assumed that the single sheet is held simultaneously by the conveyance roller to be controlled and the other conveyance roller disposed adjacent to the conveyance roller to be controlled on the upstream side.

Figure 7A:
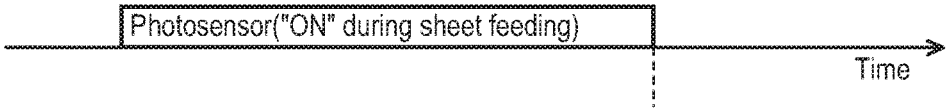
FIGS. 7A to 7F are diagrams explaining a sheet conveyance process.
Figure 7B:
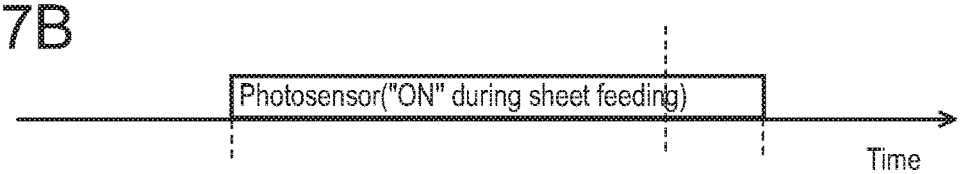

FIG. 7A shows the output of the photosensor provided in the vicinity of the other conveyance roller, and FIG. 7B shows the output of the photosensor provided in the vicinity of the conveyance roller to be controlled.

When the sheet 500 is conveyed in the conveying path inside the image forming apparatus 100, the sheet 500 first reaches the other upstream conveyance roller 171 and then reaches the conveyance roller 171 to be controlled. Therefore, as shown in FIG. 7A, the photosensor 172 in the vicinity of the other conveyance roller 171 is turned on earlier, and thereafter, as shown in FIG. 7B, the photosensor 172 in the vicinity of the conveyance roller 171 to be controlled is turned on. When the sheet 500 reaches the conveyance roller 171 to be controlled, the sheet 500 is simultaneously held by the conveyance roller 171 to be controlled and the other conveyance roller 171.

Figure 7C:
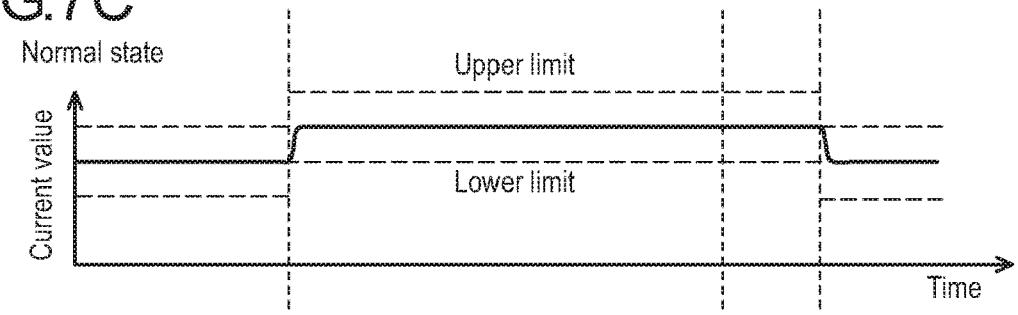
Figure 7D:
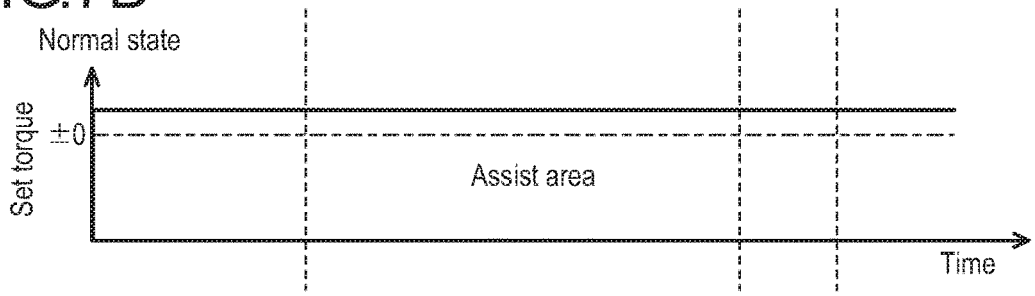

FIG. 7C shows the effective current value of the stepping motor 210 in the case where there is no speed difference between the sheet conveyance speed of the conveyance roller to be controlled and the sheet conveyance speed of the other conveyance roller. FIG. 7D shows the output torque of the DC brushless motor 220 at this time. The effective current value of the stepping motor 210 corresponds to the load acting on the stepping motor 210.

When there is no speed difference between the sheet conveyance speeds of the two pairs of conveyance rollers 171, the load acting on the conveyance roller 171 to be controlled is not affected by the other conveyance rollers 171, and is affected only by the sheet 500. Therefore, as shown in FIG. 7C, when the sheet 500 reaches the conveyance roller to be controlled, the load acting on the stepping motor 210 temporarily increases due to the influence of the sheet 500. When the sheet 500 has passed through the conveyance roller 171 to be controlled, the load acting on the stepping motor 210 decreases. During this time, as shown in FIG. 7D, the DC brushless motor 220 performs assist control in which the rotation of the stepping motor 210 is assisted with a predetermined torque.

Figure 7E:
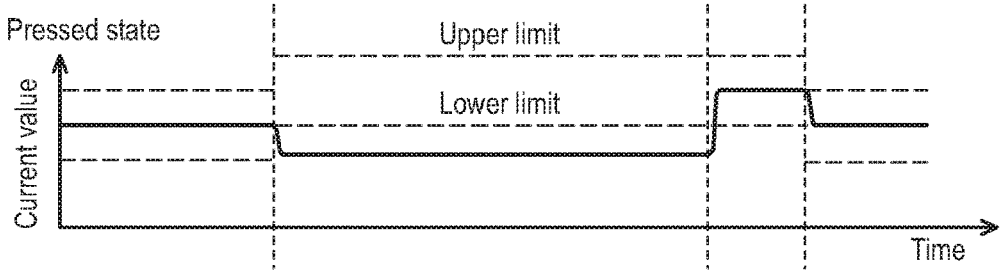
Figure 7F:
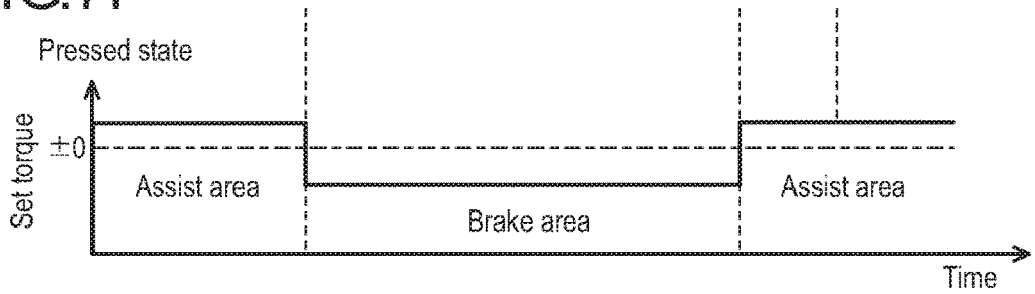

FIG. 7E shows the current value of the stepping motor 210 in a state where the sheet conveyance speed of the conveyance roller to be controlled is slower than the sheet conveyance speed of the other upstream conveyance roller, and the sheet 500 to be conveyed has stiffness of a predetermined value or more. FIG. 7F shows the output torque of the DC brushless motor 220 at this time.

As shown in FIG. 7E, when the sheet conveyance speed of the conveyance roller 171 to be controlled is slower than the sheet conveyance speed of the other upstream conveyance roller 171 and the sheet 500 to be conveyed has stiffness of the predetermined value or more, the conveyance roller 171 to be controlled is pushed by the upstream conveyance roller via the sheet 500. When the conveyance roller 171 to be controlled is pushed by the other conveyance roller, the load acting on the stepping motor 210 decreases.

In such a case, in the sheet conveyance process of this embodiment, as shown in FIG. 7F, the output torque of the DC brushless motor 220 is reduced, and the brake control in which the power of the DC brushless motor 220 prevents the stepping motor 210 from rotating is performed. With such the configuration, even if the load acting on the stepping motor 210 is reduced due to the push of the conveyance roller 171 to be controlled by the other conveyance roller 171, it is possible to prevent a step-out of the stepping motor 210.

In the above-described embodiment, the case where the sheet conveyance speed of the conveyance roller to be controlled is slower than the sheet conveyance speed of the upstream conveyance roller has been described as an example. On the other hand, when the sheet conveyance speed of the conveyance roller to be controlled is higher than the sheet conveyance speed of the conveyance roller of the upstream side, the conveyance roller to be controlled is pulled by the other conveyance roller via the sheet 500 and the load acting on the stepping motor 210 increases. In this case, the DC brushless motor 220 is controlled so that the power of the DC brushless motor 220 is strong in the assist direction. Specifically, the DC brushless motor 220 is controlled so that the output torque of the DC brushless motor 220 increases.

Further, also in the case where the sheet 500 is held simultaneously by the conveyance roller to be controlled and the other conveyance roller disposed downstream of the conveyance roller, the control of the DC brushless motor 220 is similarly performed. More specifically, when the sheet conveyance speed of the conveyance roller to be controlled is slower than the sheet conveyance speed of the downstream conveyance roller, the conveyance roller to be controlled is pulled by the other conveyance roller via the sheet 500 and the load on the stepping motor 210 decreases. In this case, the DC brushless motor 220 is controlled so that the power of the DC brushless motor 220 is strong in the braking direction. Specifically, the DC brushless motor 220 is controlled so that the output torque of the DC brushless motor 220 decreases. On the other hand, in a case where the sheet conveyance speed of the conveyance roller to be controlled is higher than the sheet conveyance speed of the downstream conveyance roller, when the conveyed sheet has stiffness of the predetermined value or more, the conveyance roller to be controlled pushes the other conveyance roller via the sheet 500, and the load on the stepping motor 210 increases. In this case, the DC brushless motor 220 is controlled so that the power of the DC brushless motor 220 is strong in the assist direction. Specifically, the DC brushless motor 220 is controlled so that the output torque of the DC brushless motor 220 increases.

In the sheet conveyance process of the present embodiment, the output torque of the DC brushless motor 220 is adjusted according to the load acting on the stepping motor 210, so that according to the load acting on the stepping motor 210, neutral control in which the power of the DC brushless motor 220 does not affect the rotation of the stepping motor 210 is performed.

As described above, according to the sheet conveyance process of the present embodiment, depending on the conveyance state of the sheet 500 conveyed by the conveyance roller 171, the control of the DC brushless motor 220 is switched between the assist control, the brake control, and the neutral control. According to such the configuration, the load acting on the stepping motor 210 is adjusted, and step-out of the stepping motor 210 is prevented.

Further, according to the sheet conveyance process of the present embodiment, the output torque of the DC brushless motor 220 is changed by comparing the effective current value of the stepping motor 210 with the predetermined reference current value. According to such the configuration, it is possible to easily determine the direction of control of the DC brushless motor 220. Further, since the reference current value is set according to the type of the sheet 500, stable conveyance control is possible.

Finally, with reference to FIG. 8, the step-out upper limit torque of the stepping motor 210 will be described.

Figure 8:
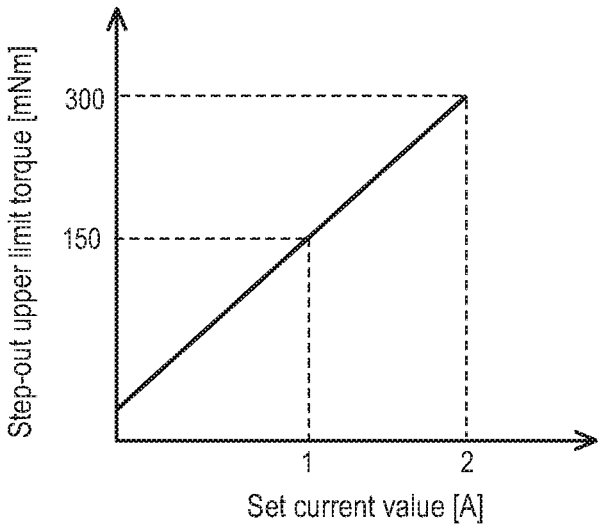
FIG. 8 is a diagram explaining a step-out upper limit torque of the stepping motor.

FIG. 8 is a diagram explaining the step-out upper limit torque in the rotational direction of the stepping motor 210. The vertical axis in FIG. 8 is the upper limit value of the step-out torque, and the horizontal axis is the set current value.

As shown in FIG. 8, the step-out upper limit torque in the rotational direction of the stepping motor 210 decreases as the set current value of the stepping motor 210 decreases. When the stepping motor 210 is assisted by the DC brushless motor 220, the set current value of the stepping motor 210 is set small in consideration of the assist torque from the DC brushless motor 220. Therefore, for example, in the case where the stepping motor 210 is assisted by the DC brushless motor 220, when the conveyance roller to be controlled is pushed by the other upstream conveyance roller the torque in the rotation direction increases and the stepping motor 210 may step out. However, according to the sheet conveyance process of the present embodiment, even if the conveyance roller to be controlled is pushed, the output torque of the DC brushless motor 220 is reduced and the torque in the rotational direction is adjusted. As a result, an increase in the torque in the rotational direction is prevented, and step-out of the stepping motor 210 is prevented.

The present invention is not limited only to the embodiments described above, and various modifications can be made within the scope of the claims.

For example, in the above-described embodiment, when the effective current value of the stepping motor 210 is not within the predetermined upper and lower range, the output torque of the DC brushless motor is changed with reference to the duty setting table 300. However, the output torque of the DC brushless motor may be changed with reference to the duty setting table 300 without determining whether the current value of the stepping motor 210 is within the predetermined upper and lower range.

Further, in the above-described embodiment, the load acting on the stepping motor 210 is detected by detecting the current value of the stepping motor 210. However, it is also possible to calculate the speed difference between the sheet conveyance speeds of respective conveyance rollers from the detection timing of the plurality of photosensors on the sheet conveying path to predict the load acting on the stepping motor 210.

Further, in the above-described embodiment, the case where the drive apparatus 200 of the present invention is applied to the image forming apparatus 100 has been described as an example. However, the drive apparatus 200 of the present invention may be applied to a post-processing apparatus coupled to the image forming apparatus, and may drive the rotating shaft of the conveyance roller inside the post-processing apparatus.

The means and method for performing various processes in the image forming apparatus 100 according to the above-described embodiment can be implemented by either a dedicated hardware circuit or a programmed computer. The program may be provided through a computer-readable recording medium such as a CD-ROM (Compact Disc Read Only Memory), or may be provided online via a network such as the Internet. In this case, the program recorded on the computer readable recording medium is usually transferred to and stored in a storage such as a hard disk. Further, the above program may be provided as standalone application software or may be incorporated in software of the image forming apparatus as one function thereof.

Although embodiments of the present invention have been described and illustrated in detail, the disclosed embodiments are made for purposes of illustration and example only and not limitation. The scope of the present invention should be interpreted by terms of the appended claims.

What is claimed is:

1. A drive apparatus comprising:

a stepping motor that transmits power to a rotating shaft of a conveyance roller for conveying a sheet;

a brushless motor that transmits power to said rotating shaft of said conveyance roller;

a controller configured to control an operation of said stepping motor so that said stepping motor rotates at a constant speed; and the controller being further configured to control an operation of said brushless motor, wherein said controller switches control of said brushless motor between, in accordance with a conveyance state of the sheet conveyed by said conveyance roller, assist control in which power of said brushless motor assists a rotation of said stepping motor, brake control in which power of said brushless motor prevents a faster rotation of said stepping motor, and neutral control in which power of said brushless motor does not affect the rotation of said stepping motor.

2. The drive apparatus according to claim 1, wherein said conveyance roller to be controlled, and another conveyance roller adjacent to said conveyance roller to be controlled along a sheet conveying direction hold and convey one sheet simultaneously, a conveyance state of said sheet changes in accordance with a speed difference between a sheet conveyance speed of said conveyance roller to be controlled and a sheet conveyance speed of said another conveyance roller, and said controller detects a load acting on said stepping motor according to said speed difference to switch control of said brushless motor.

3. The drive apparatus according to claim 2, wherein said controller detects said load by detecting a current value of said stepping motor.

4. The drive apparatus according to claim 2, wherein said controller adjusts an output torque of said brushless motor according to a fluctuation of said load.

5. The drive apparatus according to claim 2, wherein in a case where said another conveyance roller is disposed upstream of said conveyance roller to be controlled, said controller controls said brushless motor so that an output torque of said brushless motor decreases when said conveyance roller to be controlled is pushed by said another conveyance roller via said sheet, and controls said brushless motor so that the output torque of said brushless motor increases when said conveyance roller to be controlled is pulled from said another conveyance roller via said sheet, and in a case where said another conveyance roller is disposed downstream of said conveyance roller to be controlled, said controller controls said brushless motor so that the output torque of said brushless motor decreases when said conveyance roller to be controlled is pulled from said another conveyance roller via said sheet, and controls said brushless motor so that the output torque of said brushless motor increases when said conveyance roller to be controlled pushes said another conveyance roller via said sheet.

6. The drive apparatus according to claim 5, wherein in a case where said another conveyance roller is disposed upstream of said conveyance roller to be controlled:

when a sheet conveyance speed of said conveyance roller to be controlled is slower than a sheet conveyance speed of said another conveyance roller, and said sheet has stiffness of a predetermined value or more, said conveyance roller to be controlled is pushed by said another conveyance roller via said sheet; and when the sheet conveyance speed of said conveyance roller to be controlled is higher than the sheet conveyance speed of said another conveyance roller, said conveyance roller to be controlled is pulled by said another conveyance roller via said sheet, and wherein in a case where said another conveyance roller is disposed downstream of said conveyance roller to be controlled:

when the sheet conveyance speed of said conveyance roller to be controlled is slower than the sheet conveyance speed of said another conveyance roller, said conveyance roller to be controlled is pulled by said another conveyance roller via said sheet; and when the sheet conveyance speed of said conveyance roller to be controlled is higher than the sheet conveyance speed of said another conveyance rollers, and said sheet has a stiffness of a predetermined value or more, said conveyance roller to be controlled pushes said another conveyance roller via said sheet.

7. An image forming apparatus comprising the drive apparatus according to claim 1.

* * * * *